US005182890A

United States Patent [19]

Peters

[11] Patent Number: 5,182,890

[45] Date of Patent: Feb. 2, 1993

[54] ATTACHMENT PLATE FOR ROOFING SHEETS

[76] Inventor: William H. Peters, P.O. Box 184, W. Unity, Ohio 43570

[21] Appl. No.: 557,549

[22] Filed: Jul. 24, 1990

[51] Int. Cl.[5] ..... E04D 5/14

[52] U.S. Cl. ..... 52/410; 52/512

[58] Field of Search ..... 52/410, 512, 459, 222; 215/273

[56] References Cited

U.S. PATENT DOCUMENTS

| | | | |
|---|---|---|---|
| 700,344 | 5/1902 | Lispenard | 215/273 |
| 4,496,071 | 1/1985 | Stewart | 215/273 |
| 4,586,301 | 5/1986 | Hickman | 52/410 |
| 4,619,094 | 10/1986 | Yang | 52/410 |
| 4,651,490 | 3/1987 | Marston | 52/310 |
| 4,660,347 | 4/1987 | Resan | 52/410 |
| 4,854,105 | 8/1989 | Delisle | 52/410 |

*Primary Examiner*—James L. Ridgill, Jr.
*Attorney, Agent, or Firm*—George R. Royer

[57] ABSTRACT

The subject invention is a roofing attachment plate with integrated means to seal and affix such plate on the upper part of a roof surface in order to secure a roof sheet to the upper surface of a roof. Specifically, the invention comprises a circular member on other shaped attachment plate which is adapted to be placed flush on the upper surface of the roof deck with opening means to receive a nail or stud to attach the plate to the roof structure, serving to anchor a roofing sheet to the fixed roof structure. The fastening plate has an upper cup-like chamber that is centrally located on the attachment plate and coaxially aligned with the central vertical axis of the fastening member, and such chamber has an outer circumferential surface, a portion of which has a circumferential recess to receive and hold a circular locking ring. The roofing sheet is placed over top of the cup-like chamber and secured to the attachment plate by placing a flexible cap-like member over the roofing sheet and over the cup-like chamber with a circular locking ring inserted in the cap to lock the rubber roofing sheet in place. In an alternate embodiment of the subject invention, an additional cup member, of a soft and pliable material, is placed over the rubber roof sheet prior to the placement of the outer cap member. This additional, or inner, cap member helps prevent damage to the rubber roof sheet by the outer cap member and locking ring.

4 Claims, 1 Drawing Sheet

ATTACHMENT PLATE FOR ROOFING SHEETS

BACKGROUND OF INVENTION AND DESCRIPTION OF PRIOR ART

This invention applies to roofing applications in situations where rubber roof sheets are applied to the upper deck of a roof surface. Accordingly, in many roofing applications wherein rubber roof sheets are placed over the top of the roof deck, the strategically placed bonding plates are affixed over the top of the rubber roof sheets in order to attach the roof sheets over the upper roof surface. A conventional system in utilizing such fastening plates involves placing such plates in series of evenly-spaced rows and columns regularly and symmetrically spaced. Such fastening plates function to securely hold the roofing sheets securely in place against the rubber surface, with the aid of a fastening device, such as a longitudinally extending screw-like or nail-like member being forcibly thrust downwardly through the horizontally disposed fastening plate through the roof sheet material, and into the roof deck or fixed roof structure in order to affix the fastening plate and the roof sheet. Therefore, the conventional practice, as stated, is to affix the bonding plates over the top of the rubber roof sheet as placed over the upper roof surface, using nails or screws in order to firmly adhere the bonding plate against the upper surface of the roofing sheets and into the roof.

One of the main problems encountered with the use of nails or screws or similar objects in attaching such bonding plates is that when they are inserted into the roof deck, they can generally cause distortion damage in the wood or other roof material immediately around the screw or nail. Such damage usually leaves gaps or spaces adjacent the screw or nails. This, in turn, yields weakness in the roof structure and also yields a potential source of roof leaks through the nail openings, thereby permitting water to flow into the roof infrastructure. Yet another problem that is found in this respect is that at times when the nail or screw-like member is lodged through the roof structure at an angle from the vertical, the hole in the roof becomes uneven and the top plate does not rest securely and flush against the roof surface. As a result, air and water may penetrate through the roof at this juncture. Still another problem encountered with the use of traditional or existing attachment plates is that they do not effectively seal the roofing sheet. More specifically, one of the major problems with the use of existing roof fasteners is that they do not effectively seal the roof structure against seepage of water and air, and therefore cause problems with the roof integrity. Other problems are encountered in this regard, and one of the main quests in securing rubber roof sheets to the roof deck is to prevent any problems that will cause damage to the rubber roof sheet. This invention is therefore directed to overcome the foregoing problems and the following objects are directed accordingly.

OBJECTS

In view of the above, it is an object of the subject invention to provide an improved device for attaching roofing sheets to the upper area of a roof;

A main object of the subject invention is to provide a roofing attachment plate that helps protect the integrity of the rubber roof sheet;

Still another object of the invention is to provide a fastening device for attaching rubber roof sheets for covering roof structure;

An object of the subject invention is to provide an improved securing apparatus for affixing roofing materials to a roof structure;

Yet another object of the subject invention is to provide an improved fastening device;

Another object of the invention herein is to provide an improved device for affixing roof sheets to the upper surface of a roof;

Yet another object is to provide a fastening device that is secured with a removable key;

Still another object of the device is to permit disassembly and reassembly without removing it from the roof structure;

Another object of the device is to attain all of the above without penetration of the rubber membrane;

Another object is to provide a key locking mechanism to prevent accidental disassembly;

A further object of this invention is to provide an attachment system for rubber roof sheets that will keep the rubber roof from chaffing;

Another object is to provide fast and simple application of roofing membrane;

Still another object of the subject invention is to provide a rubber roof attachment plate that has a scuff prevention plate to protect the integrity of the rubber roof;

Yet another object is to provide a device by which the roof membrane may be removed with only partial disassembly of the retaining device, thus avoiding cutting and patching the roof membrane for reattachment to the retaining device;

A further object of the subject invention is to provide a rubber roof attachment plate that has an integral scuff prevention device incorporated therein;

Another object of the device is a retaining key to provide frictional cooperation between roof membrane and cap to provide positive ingress and egress;

Another object of the device is a restrictive screw opening that allows ingress of the screw head during application and prevents egress during its functional use;

Other and further objects will become apparent from a reading of the following description taken in conjunction with the claims and drawings.

DESCRIPTION OF GENERAL EMBODIMENT

Figure 1:
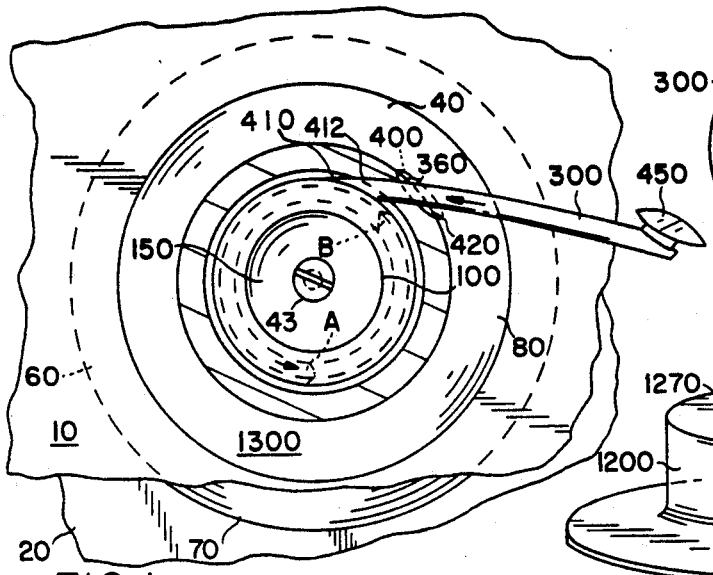
FIG. 1 is a top elevational view of the device utilizing the invention herein, shown partially cut-away.

The subject invention is a roofing attachment plate with integrated means to seal and affix such plate on the upper part of a roof surface in order to secure a roof sheet to the upper surface of a roof. Specifically, the invention comprises a circular member on other shaped attachment plate which is adapted to be placed flush on the upper surface of the roof deck with opening means to receive a nail or stud to attach the plate to the roof structure, serving to anchor a roofing sheet to the fixed roof structure. The fastening plate has an upper cup-like chamber that is centrally located on the attachment plate and coaxially aligned with the central vertical axis of the fastening member, and such chamber has an outer circumferential surface, a portion of which has a circumferential recess to receive and hold a circular locking ring. The roofing sheet is placed over top of the cup-like chamber and secured to the attachment plate by placing a flexible cap-like member over the roofing sheet and over the cup-like chamber with a circular locking ring inserted in the cap to lock the rubber roofing sheet in place.

DESCRIPTION OF PREFERRED EMBODIMENT

In describing the preferred and other potential embodiments of the subject invention, it is to be indicated at this point that the following descriptions center on only a few of the potential embodiments of the subject invention, and therefore such descriptions shall not be construed as limiting the scope of the invention.

The invention herein relates to an apparatus used for affixing roof sheets to the upper surface of a roof of any type. Further, the subject invention is most generally directed to roof structures wherein the roof is horizontal, however, it is not to be so limited, as other than flat roofing structures are amendable for use of the subject invention. Additionally, while the following description is directed to a situation wherein the bonding plates are attached over top of the rubber roof sheets, this invention is equally applicable to those circumstances where the fastening plates are placed between the upper roof surface and the lower surface of the roofing sheets. This invention is particularly adapted to this latter arrangement or a hybrid arrangement wherein the bonding plate is comprised of two layers between which layers the roofing sheet is placed and locked in place so as to obviate the need to pierce the rubber roof sheet with nails or screws. However, it is to be noted that this invention is not limited solely to the process of affixing rubber roof sheets to the upper deck of a roof and may be used in conjunction with other types of roof coverings.

Attention is now directed to the drawings in which a preferred embodiment of the subject invention is shown. The subject invention involves a device and method to aid in the affixing of roof sheets, such as roof sheet 10 to a roof surface such as roof 20, shown in FIG. 4. In this respect, the roof 20 is shown as a horizontally disposed flat roof having perimeter edges, not shown. Such roof 20 is considered generally conventional in this regard, however, the subject invention can apply to a roof of any configuration, irrespective whether it is rectangular, flat, or of other structural shape.

In the process of attaching roof sheets to roof 10 when using the subject invention, such as rubber roofing sheets, the first step in the process is to lay a plurality of fastening plates such as plates of the type incorporating the subject invention, in a flat or flush manner to the upper surface 30 of the roof deck 20. The rubber roof sheets are placed over the top surfaces of the fastening plates so that all such sheets cover the entire roof surface 30 in a flush manner end to end and side by side as well as the fastening plates. The next subsequent step involves placing rubber roof sheets over the top of the various fastening plates, such as plate 40, which may be positioned and affixed over the upper surface of the roof deck 20, as shown. Fastening plates, such as plate 40, are generally positioned and affixed in a series of evenly-spaced rows and columns, in a similar grid pattern over the upper roof surface 30, although this layout feature is not critical to the subject invention and the subject plate device may be affixed or applied in any regular or irregular pattern. The next subsequent step in the attachment process after the rubber roof sheets are laid on top of the fastening plates is to affix a suitable fastening member over the rubber roofing sheet 10 to secure the rubber roof sheet to the upper part of the fastening plate 40 as already affixed to the roof 20, as stated above. As discussed above, the horizontal fastening plate 40 is used as an intermediate holding member fastened over top of top of the roof deck with fastening device, such as screw 40, inserted downwardly through a vertical opening 42 in such fastening plate 40 for such fastening procedure. In the embodiment shown in the drawings and described herein, the fastening plate 40 as shown, incorporates features of the subject invention as more fully described below, is placed under the roof sheet.

Certain roofing applications are better suited for screws as opposed to nails or other devices to secure the fastening plate 40 to the roof 20. In this latter regard, irrespective of whether the fastening member is a nail, spike, screw, or other similar longitudinally extending member, the fastening member is adapted to extend vertically downwardly through opening 46 in the attachment plate 40, as shown, and through the roof 20 to secure the fastening plate 40 to the roof as stated.

In describing the preferred embodiment of the subject device, it is to be stressed at this point that the description herein will be directed to an attachment plate 40, as shown in FIG. 1. However, it is to be noted that the subject invention may involve other variant forms and embodiments than that shown and described herein, and thus, while the specific description below is directed to the embodiment shown in the drawings, the scope of this invention is not so limited. Other embodiments fall within the scope of the invention herein.

As shown in the drawings, the attachment plate 40 is shown as generally comprising in its basic overall structure, a disc-like plate component 60, referred to hereinafter as disc component, a generally circular configuration, as viewed from a top planar view as shown in FIG. 1, and as viewed from FIG. 2. The circular planar configuration for the disc component 60 is not critical, as such disc may be configured other than that of a circular member, or precisely as a flat plate member. Additionally, other shapes and configurations may fall within the scope of the subject invention.

Disc 60 is shown as preferably being of an inverted saucer-type shape. More specifically, disc 60 has an external circumferential rim 70, and as shown in the drawings, and particularly FIG. 1, disc 60 forming the main basic component of the fastening plate 40 is a circular disc member with an inverted saucer shape having an upper surface 80 and a lower surface 90. More particularly, disc 60 has a circumferential rim 70 and an upper surface 80 and a lower surface 90, with both such surfaces being inclined upwardly towards the center of the disc 60 from its rim 70. As seen in FIG. 2, when the disc 60 is placed with the lower surface 90 facing downwardly, the disc 60 rests on circumferential rim 70 with the middle or central portions rising upwardly in slight V-shaped fashion, as seen in the cross-sectional, side elevated view of FIG. 2. By this constructional relationship when placed flush against a roof surface, the disc 60 will rest on the rim 70 with the remaining part of the lower surface 90 of the disc 60 extending slightly above the roof deck 20, as shown in FIG. 2.

Integrally formed on the central part of the upper surface 80 of such disc 60 is an upwardly protruding cup-like member 100. More particularly, the upwardly protruding cup member 100 is formed by an upwardly protruding circumferentially extending wall 120, which circular wall 120 has an outer circumferential surface 130 and an inner circumferential surface 140. The lower part of the circumferential wall 120 is a continuous and integral extension of the upper surface 80 and of the disc 60 formed in a circumferential manner as a circumferentially upper protruding lip. The space inside the inner circumferential wall 120 and inside the inner surface 130 forms an inner cup-like chamber 150 which has an opening at the top and a bottom surface which is solid, except for nail-screw opening 46, indicated above. Integrally formed into the bottom surface of the cup-like chamber 150 is the opening 46 which extends vertically downwardly into a longitudinally extending manner completely through disc 60 and to the lower surface 90 of disc 60. A nail, screw, etc. inserted into the opening 46 is adapted to penetrate the roof 20 to anchor the fastening plate 40 to the roof 20, as shown in the drawings.

Moreover, as seen in the drawings, the extreme upper circumferential part of the outer circumferential surface of the wall 120 of cup member 100 has a circumferentially disposed, radially outwardly protruding circumferential lip 210. Such lip 210 forms on its immediate undersurface a circumferentially extending recess 220 in the outer circumferential surface of said wall as seen. Such recess 220 formed on the under surface of the lip 210 is adapted to receive therein a circular locking pin 300 which fits between the outer cap 320 and cup 100, as more fully described below.

Figure 2:
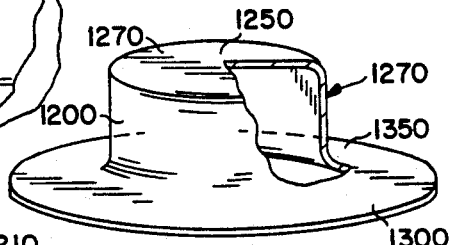
FIG. 2 is a side elevational view, in cross section, of the device.

More specifically, the outer cap 320 is structured as a cylindrically-shaped cap member inverted with the open part facing downward to be inserted around and over the top of the cup member 100 as shown in FIG. 2 after the rubber roof membrane 10 is placed over the cup member 100. Conformingly, the outer cap 320 has an outer circumferential wall 330 and solid upper surface 340. Integrally formed into the outer circumferential wall of the outer cap 320 is an opening port 360 which is adapted to receive locking pin 300. As seen from the upper cross-sectional elevational view of the outer cap 320 in FIG. 2, the opening port 360 has a flat forward or leading edge 400, which edge is aligned with a radius extending from the center of the outer cap 320, while the following or rear side wall 412 of the opening 360 is angled away from the leading edge 420. One of the rubber roof sheets 10 is placed over the top of cup 100 and the outer cap 320 and is placed over the rubber sheet 10. Then the forward end 306 of the locking pin 300 is inserted through the port opening 360 and is pushed around the recess 220 until it fits circumferentially and completely around such recess 220 in a circumferentially conforming manner. Once the pin 300 is locked into this latter position, the outer cap 320 is rotated in a clockwise manner until such depresses the pin 300 against the rubber roof sheet 10, thereby locking the pin 300 in place against the rubber roof sheet 10, as shown in the drawings. This rotation also serves to frictionally lock the pin 300 in a static position. This locking occurs after the plate 40 has been affixed to the roof surface 20, thus integrally locking the roof sheet 10 on the upper part of the fastening plate 40, as already secured to the roof 20.

Figure 3:
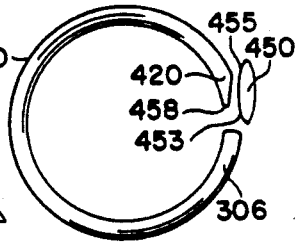
FIG. 3 is a top elevational view, of the locking ring shown in FIG. 1.

More particularly, the locking pin 300 is an elongated member capable of being readily formed into a circular member, as shown in FIG. 3. The forward end 306 of the locking member 300 is somewhat rounded, in the preferred embodiment, but not critically so. The posterior end 420 of the locking pin has a protruding knob 450 with a forward edge 458 that extends beyond the outer surface of such locking pin 300. Also in the preferred embodiment of the subject invention, the locking pin has a reduced diameter portion 455 just immediately forward of edge 458 of knob 450, and on the forward part of the reduced diameter portion of the locking pin 300 is an increased section 453, which is viewed as being somewhat wedge-shaped as seen from the top elevational view of FIG. 4 and, as seen in the top elevational, sectional view of FIG. 1. The interior circumferential wall of the outer cap 320 has a radially outwardly-formed wedge-shaped cut 410 just adjacent the edge 412 of opening 360.

Figure 4:
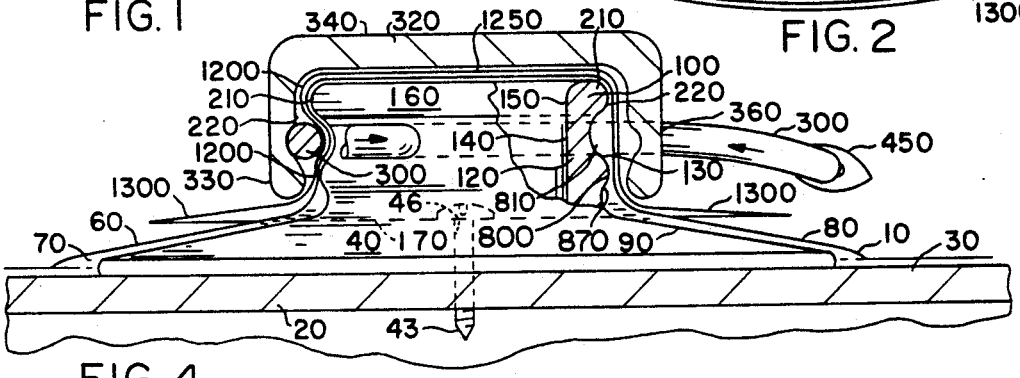
FIG. 4 is a side elevational view of the cup device, in cross section, as used in the subject invention.

Once the plate 40 is placed over the upper surface of the roof deck 20, and affixed thereto by nails, screws, etc. as seen in FIGS. 1 and 2, a portion of rubber roof sheet 10 is placed over the top edge of cup member 100. Once the rubber roof sheet is placed over the top of cup member 100, the outer cap member 320 is placed conformingly over the top of the rubber roof sheet 10 portion already placed over top of the cup-like member 100, as shown in FIG. 4. Once the outer cap member 320 is pushed down over top of the cup-like member 100 in the fully inserted downwardly position shown in the drawings, the forward end 306 of the locking pin 300 is inserted into the opening 360 in the outer cap in a counterclockwise direction towards edge 412 of opening 360, as can be seen in FIG. 1. Thereafter, the locking pin 300 is thrust or pushed completely around the cup-like member 100 in such counterclockwise direction around the inner circumference of the outer cap 320 and around the outer circumferential surface of the cup-like member 100 in a positional relationship so that the locking pin fits conformingly and circumferentially in the circumferential recess 220 in the cup-like member's outer circumferential wall, as specifically shown in FIG. 2. As the locking pin 300 is pushed circumferentially around the circumferential recess 220, the raised circumferential portion 453 can be locked into wedge-like opening 410 inside cap-like member and the knob 450 is locked at opening 360 by reason of its size relative to opening 360. Once the locking pin is so emplaced, the outer cap 320 is rotated to further seat the locking pin 300 in the circumferential groove 220 and seat the rubber roof 10 firmly without tearing or damaging the rubber roof material.

Referring now to the drawings and particularly FIG. 2 in which an alternate embodiment of the cup-like member 100 is shown. In this alternate embodiment, the outer circumferential wall 120 of the cup-like member 120 is formed with a secondary circumferentially extending lip 800 formed near the lower portion of the circumferential wall 120, but not at the bottom thereof. This secondary circumferential lip 800 extends radially outward, as seen in FIG. 2, in a circumferential manner. Such circumferential lip 800 has an upper circumferential surface 810 as seen. The secondary circumferential lip 800, with the upper surface 870, as thusly described, helps to create a bottom ledge for the circumferential recess 220, thus essentially deepening the circumferential groove 220 so that the annular locking pin 300 does not tend to slip downwardly along the outer circumferential wall 120 on the cup-like member 100 when it is in place in its locking function.

As can be seen in the drawings, in one embodiment of the subject invention, an inner cap member 1200 of flexible composition is provided, such inner cap member being provided as a device to be placed conformingly and securely between the outer cap member 320 and the cup-like member 100, as shown in the drawings. More specifically, the inner cap member 1200 is formed like a hat member, having an upper open part 1250 with a solid top 1270 and a circumferential wall 1300. The brim 1350 of the inner cap member is diametrically larger than the upper part 1250, as seen in the drawings, particularly FIG. 3.

As shown in FIG. 2, the inner cap member 1200 is placed down over the upper surface of the rubber roof sheet 10 portion that is fitted conformingly over the cup-like member 100, as shown. Thus, once the rubber roof sheet 10 is placed on top of the cup-like member 100, the inner cap member is fitted conformingly over the rubber roof sheet 10 once it is fitted over the cup-like member 100. Thereafter, the outer cap member 320 is placed conformingly over top of the inner cap member 1200, as shown in FIG. 2. Thus, the inner cap member 1200, of flexible composition, is placed between the rubber roof sheet 10 and the inner surface of the outer cap member 320. This inner cap member 1200 functions to protect the rubber roof sheet 10 from being chaffed or otherwise worn by the outer cap member 320 and the locking pin 300.

Figure 6:
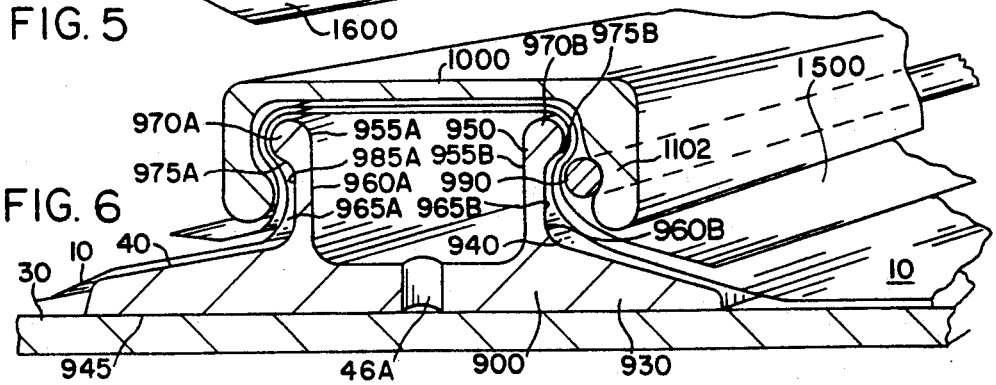
FIG. 6 is a perspective view of an alternate embodiment of the subject invention shown in partial section.

In yet another embodiment of the subject invention, an alternate fastening plate is shown as being elongated in a rectangular manner. Specifically, shown in FIG. 6 is a fastening plate 900 of an elongated, rectangular configuration. The rectangular fastening plate 900, as shown in the drawings, is as opposed to the circular plate, shown in and described above, formed with the same structural principles as the other fastening plate described above. As can be seen from FIG. 6, the fastening plate 900 comprises an elongated, longitudinally extending base member 930 having an upper surface 940 and a lower surface 945. As can be seen, formed over the upper surface 940, as an integral extension thereof, is an upwardly extending channel member 950, open at opposing ends, with parallel vertical sides 955A and 955B, each of such sides having an inner wall 960A and 960B and outer wall 965A and 965B. Both such vertically upwardly extending sides 955A and 955B extend longitudinally along the upper surface 945 of the base member 930. As can be seen, the upper edges of the outer wall 960A and 960B of vertical sides 955A and 955B has an outwardly extending continuous lip 970A and 970B respectively. The undersurface 975A and 975B of each such lip helps form a longitudinally extending indentation 985A and 985B respectively. As can be seen in FIG. 6, the longitudinal indentations are each adapted to receive a longitudinally extending locking pin, such as pin 990 shown in FIG. 6. A horizontally extending cap member 1000 of longitudinal disposition is adapted to fit over top of the channel member 950 in a conforming manner, as shown, after the rubber roof sheet 10 is placed over top of the channel 950. This cap member 1000 is open at both ends or can be closed on such ends, in a alternate form of such invention.

Figure 5:
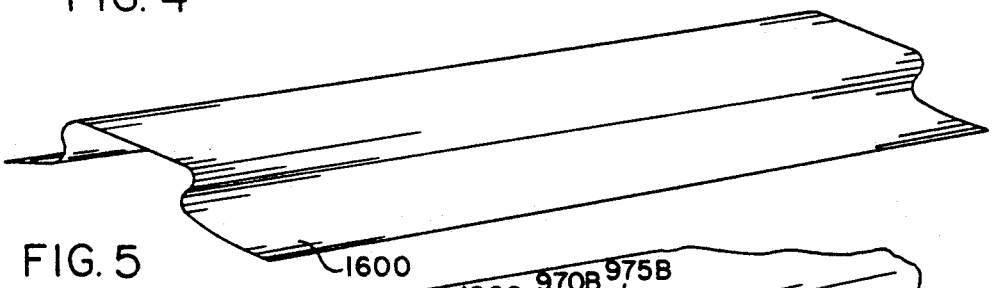
FIG. 5 is a top perspective view of the cover member used on fastening plate shown in FIG. 6.

Additionally, as shown in FIG. 5, a longitudinally extending scuff plate 1600 is adapted to be inserted between the cap member 1000 and the channel 960 to prevent damage to the rubber roof sheet 10.

I claim:

1. A fastening plate apparatus for fastening a rubber roof sheet to the upper surface of a roof deck comprising:

(a) a fastening plate member having an upper surface and a lower surface, said fastening plate having on its upper surface a cup-like member with an opening on the upper part leading to an internal cavity in such cup-like member, having an outer circumferential surface, with such fastening plate member having an opening extending from such cavity to the lower surface of said plate member, and wherein said cup-like member has a circumferentially extending groove on its outer circumferential surface, and wherein said cup-like member is adapted to receive thereover a portion of a rubber roof sheet;

(b) outer cap-like means comprising a solid, pliable material having an outer circumferential surface into which outer circumferential surface is formed an opening, said outer cap-like means being adapted to fit over said cup-like member on said plate member;

(c) circumferentially extending fastening means with a frontal end and a posterior end adapted to be inserted into opening in said cap means to lock a portion of a rubber roof sheet against the fastening plate, such circumferentially extending fastening means having enlarged diameter means with a notched surface on its posterior end;

(d) inner cap-like means formed of a flexible material adapted to fir conformingly over said cup-like member and over said rubber roof sheet.

2. A fastening apparatus for fastening a rubber roof sheet to the upper surface of a roof deck comprising:

(a) a fastening plate member having an upper surface and a lower surface, said fastening plate having on its upper surface a channel member with an opening on the upper part of said channel leading to an internal cavity in such channel member, such channel having an outer surface, with such fastening plate member having an opening extending from such cavity to the lower surface of said plate member;

(b) outer covering means adapted to fit conformingly over the channel member;

(c) inner covering means formed of a flexible material adapted to fit conformingly over said channel member and inserted between the outer covering means and the said channel member;

(d) longitudinally extending fastening means adapted to fasten the outer covering means to be fastening plate.

3. A fastening apparatus for fastening a rubber roof sheet to the upper surface of a roof deck and wherein said rubber roof sheet is placed over top of said fastening plate comprising:

(a) a rectangular base member having an upper surface and a lower surface, said base member having on its upper surface an opening on the upper part leading to an internal cavity in such base member, with such base member having an opening extending from such cavity to the lower surface of said base member;

(b) outer covering means adapted to fit conformingly over the base member after the rubber roof sheet is placed over top of the base member;

(c) inner covering means formed of a flexible material adapted to fit conformingly over the upper part of the rubber roof sheet portion fitted conformingly over top of the base member;

(d) longitudinally extending fastening means adapted to fasten the outer covering means to the fastening plate.

4. A fastening a plate apparatus for fastening a rubber roof sheet to the upper surface of a roof deck comprising:

(a) a fastening plate member having an upper surface and a lower surface, said fastening plate having on its upper surface a cup-like member with an opening on the upper part leading to an internal cavity is such cup-like member. having an outer circumferential surface, with such fastening plate member having an opening extending from such cavity to the lower surface of said plate member, and wherein said cup-like member has a circumferentially extending groove on its outer circumferentially surface;

(b) outer cap-like means having an outer circumferential surface into which outer circumferential surface is formed an opening;

(c) circumferentially extending fastening means with a frontal end and a posterior end adapted to be inserted into the opening in said cap like means to lock rubber roof sheets against the fastening plates;

(d) such circumferentially extending fastening means having enlarged diameter means with a notched surface on its posterior end;

(e) inner cap-like means formed of a flexible material adapted to fit conformingly over said cup-like member.

* * * * *